US011819153B2

(12) United States Patent
Russell

(10) Patent No.: US 11,819,153 B2
(45) Date of Patent: Nov. 21, 2023

(54) DUVET AND METHOD

(71) Applicant: Ruby Russell, Sparks, NV (US)

(72) Inventor: Ruby Russell, Sparks, NV (US)

( * ) Notice: Subject to any disclaimer, the term of this patent is extended or adjusted under 35 U.S.C. 154(b) by 8 days.

(21) Appl. No.: 17/944,100

(22) Filed: Sep. 13, 2022

(65) Prior Publication Data

US 2023/0078278 A1 Mar. 16, 2023

Related U.S. Application Data

(60) Provisional application No. 63/243,653, filed on Sep. 13, 2021.

(51) Int. Cl.
*A47G 9/02* (2006.01)

(52) U.S. Cl.
CPC ..... *A47G 9/0207* (2013.01)

(58) Field of Classification Search
CPC ..... A47G 9/0207; A47G 9/0261
See application file for complete search history.

(56) References Cited

U.S. PATENT DOCUMENTS 938,968 A * 11/1909 Caldwell ..... A47G 9/0261 5/501
3,541,620 A * 11/1970 Chapuis ..... A47G 9/0207 5/413 R
4,646,375 A * 3/1987 Parker ..... A47G 9/0246 5/923
5,887,299 A * 3/1999 Phillips ..... A47G 9/0207 5/413 R
6,952,845 B1 * 10/2005 Akkad ..... A47G 9/062 5/419
8,458,832 B1 * 6/2013 Krishna ..... A47G 9/0261 5/501
8,495,773 B2 * 7/2013 Liversage ..... A47G 9/0246 5/497
9,420,904 B1 * 8/2016 Russell ..... A47G 9/0238
10,413,099 B2 * 9/2019 Stewart ..... A47G 9/0261
10,945,542 B2 * 3/2021 Muthanandam ..... A47G 9/0261
(Continued)

FOREIGN PATENT DOCUMENTS

EP 0026968 A1 * 4/1981 ..... A47G 9/02
EP 2465391 A1 * 6/2012 ..... A47G 9/0261
(Continued)

*Primary Examiner* — Eric J Kurilla
(74) *Attorney, Agent, or Firm* — John D. Long, Esq; LONG & CHYBIK

(57) ABSTRACT

The invention is a duvet and method of operating same, the duvet comprising a base cover and tab sheet, the base cover defines a hollow interior accessible through a resealable aperture that continuously located along a base cover bottom edge that is adjacent to one base cover side edge, the hollow interior further configured to removably receive a quilt or the like and a continuous seam forms the base top edge and adjacent another base cover side edge, the tab sheet that has a pocket portion and base portion, the base portion attaches to the base cover proximate to the base cover bottom edge while the pocket portion forms an open-end pocket having an pocket aperture that opens out upon the base portion, the open-ended pocket being sufficiently constructed to accommodate at least a portion of an operator's hand.

20 Claims, 13 Drawing Sheets

(56) References Cited

U.S. PATENT DOCUMENTS

| | | | | |
|---|---|---|---|---|
| 2004/0187210 | A1* | 9/2004 | Hickman | A47G 9/0253 5/482 |
| 2005/0071924 | A1* | 4/2005 | Ratigan | A47G 9/0223 5/497 |
| 2005/0144721 | A1* | 7/2005 | Linnane | A47G 9/0261 5/501 |
| 2005/0246838 | A1* | 11/2005 | Wirtz | A47G 9/0261 5/501 |
| 2006/0031987 | A1* | 2/2006 | Stanfield | A47G 9/0207 5/486 |
| 2011/0023235 | A1* | 2/2011 | Gold | A47G 9/0261 112/475.16 |
| 2012/0186014 | A1* | 7/2012 | Shattuck | A47G 9/0223 5/500 |
| 2015/0282645 | A1* | 10/2015 | Sorgeloos | A47G 9/0261 5/502 |
| 2018/0092473 | A1* | 4/2018 | Stewart | A47G 9/0207 |
| 2019/0059618 | A1* | 2/2019 | Jocic | A47G 9/04 |
| 2020/0060447 | A1* | 2/2020 | Fravel | A47G 9/0261 |
| 2022/0079359 | A1* | 3/2022 | Cassel | A47G 9/0261 |

FOREIGN PATENT DOCUMENTS

| | | | | |
|---|---|---|---|---|
| EP | 2898798 | A1 * | 7/2015 | A47G 9/0207 |
| EP | 3017726 | A1 * | 5/2016 | A47C 21/046 |
| FR | 2858532 | A1 * | 2/2005 | A47G 9/0261 |
| FR | 2911057 | A1 * | 7/2008 | A47G 9/0261 |
| FR | 3029761 | A1 * | 6/2016 | |
| GB | 2385521 | A * | 8/2003 | A47G 9/0261 |

* cited by examiner

DUVET AND METHOD

CROSS-REFERENCES TO RELATED APPLICATIONS

Applicants claim priority for this present patent application as being the US non-provisional patent application of the U.S. provisional patent application, Ser. No. 63/243,653, as filed on Sep. 13, 2021, which is incorporated by reference herein in its entirety.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to duvets that are used to removably enclose quilts and the like, that may be used to cover a mattress. More specifically, the present invention may relate to those duvets which further have a tab at one end that may be inserted underneath a mattress to which a bed cover or bed cloth may be applied.

BACKGROUND

The modern bed may comprise a mattress that may be supported by a support frame with one or more portions of the mattress generally being removably covered by one or more bed covers or clothes. The mattress itself could comprise of a casing made from suitable fabric, the casing further containing deformable or resilient material selected and configured for sleeping. In one possible circumstance, the mattress support could be a bed frame, futon frame or the like that may support and lift the mattress up and away from the ground. In some other instances, the bed support could be a box spring, a fabric covered frame housing a set of vertical springs, as substantially supported by the bed frame. The box spring in such situations could be located between the mattress and the bed frame.

The bed covers or bed cloths may include fitted rectangular sheets such as a mattress cover or pad, bed linens or sheets (e.g., fitted bottom sheet and non-fitted top sheets) placed over the top of the mattress cover. One or more blankets could be suitably placed over the bed sheets with a bed spread that may be placed over the blankets or quilts.

In addition to blanket or in conjunction with a blanket one or more quilts could also be used as bed covers. Additionally, a quilt may be removably enclosed within a quilt casing called a duvet. Generally, one end of the duvet may have a closeable opening or aperture through which the quilt may be removable passed through into and out of the hollow duvet interior.

In applying such bed covers, a fitted mattress cover/pad may be applied first to the mattress. Another fitted bed sheet may then be applied over the fitted mattress cover. A non-fitted bed sheet may then be laid over the fitted bed sheet with a portion of the non-fitted bed sheet being tucked in (e.g., the operator could grasp the appropriate sheet edge and insert the sheet edge) under one end of the mattress (e.g., a foot end). In this manner, the sheet edge could be inserted in between a bottom of the mattress and a top of the mattress support. A blanket may then be laid over the non-fitted sheet and suitable be tucked under the mattress in a manner similar to the non-fitted sheets. Comforters, quilts (e.g., duvet enclosed quilt), bedspreads or the like may then be suitably placed over the blanket.

One generally accepted epitome of bed making methods could be the method used in the military as well as many hotels, hospitals, using a technique known as the "hospital corner" bed making method. In the bed making method, the bed cloths or bed covers (e.g., mattress covers, sheets, blankets, etc. that are normally applied to mattress in a tucked-in manner) could be tucked in at the mattress' foot ends and sides with such resulting tension that one can literally bounce a coin (e.g., a quarter) off the top of the bed. The hospital corner bed making method basically imparts a gift-wrapping fold to the bed cover at the each of foot corners of the mattress so that bed covers or bed cloths are tucked underneath both the bed's foot ends and sides. In this manner, the bed covers or bed cloths could be pulled taut over the top of the mattress with the head end of bed being the only untucked portion of the bed. When the bed may be used, the hospital corner bed making method generally provides a good means of anchoring the bed covers or bed cloths to the mattress as a person sleeps in the bed.

As the baby boomer population continues to move from middle age to old age, there may be increased need to address issues that generally accompany this large aging population. One such issue may be that a person's physically capacity during the aging process may decrease as that physically capacity relates to physical household tasks such a bed making or may be otherwise marked by a lack of interest in making the bed (e.g., using of the hospital corner method.) As arthritis or the loss of muscular strength occurs during aging, it may become harder for the person to grasp an edge of a bed cover or bed cloth and then thrust the grasped edge in underneath a mattress (e.g., between the mattress and mattress support.) Further, the feet of the person using the bed could be uncomfortably held down by tautness of hospital corners and make it hard for such a person to swing their feet out of bed.

Another issue may be medical in nature for as the person ages, that person may become more susceptible to physical disabilities, such as foot afflictions, which may arise from diabetes, gout or other infirmities. These foot afflictions may come in the form of extreme sensitivity of pressure, pain or both. For example, gout may be diagnosed during a flare-up by having a pressure sensitivity caused by inflammation of the thalamus or big toe joint. Even the light presence of a single bed sheet upon that foot area may induce a very, very painful response for gout sufferers. Such tactile sensitivity as found in gout may also occur with diabetes patients. In such circumstances, sleeping in a bed made using the hospital corners method with a resulting bed cover/cloths tautness may make it very difficult if not painful for such sensitive people to sleep in such bed.

What may be needed therefore could be the present invention, generally comprising a duvet (e.g., a quilt removably enclosed by a duvet) and a means of using same that makes bed making easier and faster for an ageing population; provides a suitable means to anchor the duvet in a self-centering manner and further relieves the movement restriction as imposed by the hospital corner tautness. Such a duvet could comprise a base cover and a smaller tab sheet. The base cover could comprise two duvet sheets, each duvet sheet substantially being rectangular with two sheet side edges connecting a top (or head) sheet end edge with a bottom (or foot) sheet end edge. A continuous seam could partially connect the top sheet and a pair of top (e.g., head) sheet end edges and an adjacent pair of sheet side edges. The remaining pair of sheet side edges and adjacent bottom (e.g., foot) sheet end edges could define a continuous and closable duvet opening for connecting the duvet interior defined by the connected base cover sheets to the duvet exterior. The duvet opening could be reversibly sealed by a variety of ways such a spaced-apart snaps, hole and button combination, hook and loop combination, ties, and the like.

The tab sheet, being generally rectangular in shape, is neither as wide nor long as the duvet sheet. The tab sheet could further extend from one tab sheet end edge outward from the one of the bottom sheet edges. The tab sheet could be centralized relative to the said base cover bottom end edge to generally present the stem of an overall T-shape with the remainder of the duvet.

The tab sheet could further define an open-ended pocket proximate to the unattached other tab sheet end edge, the sealed end of the pocket being aligned with the other tab sheet end edge. The open-ended pocket could form an aperture that opens out onto the remaining tab sheet and could further allow passage of at least a portion of an operator's hand into the open-ended pocket.

In this manner, after the invention (e.g., a duvet cover enclosing a quilt) has been laid over the mattress (or over other bed covers previously applied to the mattress), the operator could place at least a portion of one hand into the open-ended pocket to guide at least the open-ended pocket and hand combination towards and underneath the mattress (e.g., be inserted between a mattress and a mattress support) without having to grasp the duvet to do so.

SUMMARY OF ONE EMBODIMENT OF THE INVENTION

Advantages of One or More Embodiments of the Present Invention

The various embodiments of the present invention may, but do not necessarily, achieve one or more of the following advantages:

- the ability to generally allow faster and easier making of a bed especially by persons with impaired physical capabilities;
- provide a duvet that has an open-ended pocket that allows an operator's hand(s) to insert a portion of the duvet between a mattress and mattress support without having to grasp the duvet;
- the ability to attach duvet to a mattress that provide for simple self-centering of the said duvet upon the mattress;
- provide a means for anchoring a duvet to a mattress that allow the foot end corners of the cover/cloth to be free and not be taut;
- the ability to swing one's feet out from foot end corners of a bed;
- provide an anchor means for duvets to the mattress that may help keep the duvet in place upon the mattress throughout a bed user's sleep cycle day after day; and
- provide a continuous opening along a duvet's side edge and adjacent bottom edge to provide a resealable hollow interior access which a quilt can more easily moved into or out of the duvet.

These and other advantages may be realized by reference to the remaining portions of the specification, claims, and abstract.

Brief Description of One Embodiment of the Present Invention

One possible embodiment of the invention could be a duvet comprising a base cover and tab sheet, the base cover defines a hollow interior accessible though a resealable aperture that continuously located along a base cover bottom edge that is adjacent to one base cover side edge and a continuous seam forms the base top edge and adjacent another base cover side edge, the tab sheet that has a pocket portion and base portion, the base portion attaches to the base cover proximate to the base cover bottom edge while the pocket portion forms an open-end pocket having an aperture that opens out upon the base portion, the open-ended pocket being sufficiently constructed to accommodate at least a portion of an operator's hand.

Another possible embodiment of the invention could be a duvet comprising a base cover and a smaller tab sheet with a resealable interior aperture continuously running along one duvet base cover side edge and a base cover bottom edge, wherein the tab sheet is connected to the base cover at the base cover bottom edge to form a T-shape, the tab sheet further forming an open-ended pocket having an pocket aperture that can allow passage of at least a portion of a hand of the operator into the said pocket; wherein the pocket aperture opens out onto the tab sheet in a manner that allows the operator to move at least a portion of the hand into the open-ended pocket to insert the open-ended pocket underneath a mattress to which the duvet is being applied.

Yet another possible embodiment of the invention could be a method of applying a duvet to a mattress comprising the following steps, but not necessarily in the order shown: providing a duvet comprising a base cover and a tab sheet that together forms an T-shape, base cover further comprises a resealable aperture that accesses a hollow base cover interior, the said aperture continuously running along one base cover side edge and adjacent base cover bottom edge, the tab sheet further forms a pocket portion that forms an open-end pocket having an aperture that allows passage into the open-ended pocket of at least a portion of an operator's hand; providing a mattress having a top mattress portion connected by mattress sides to a bottom mattress portion; inserting at least a portion of an operator's hand into the open-ended pocket; and directing the open-ended pocket towards the bottom mattress portion to locate at least a portion of the open-ended pocket under the bottom mattress portion.

The above description sets forth, rather broadly, a summary of one embodiment of the present invention so that the detailed description that follows may be better understood and contributions of the present invention to the art may be better appreciated. Some of the embodiments of the present invention may not include all the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, various specific embodiments in which the invention may be practiced. It is to be understood that other embodiments may be utilized and structural changes may be made without departing from the scope of the present invention.

The present invention 10 could comprise a duvet 10 and a method of use for same 200.

Figure 1:
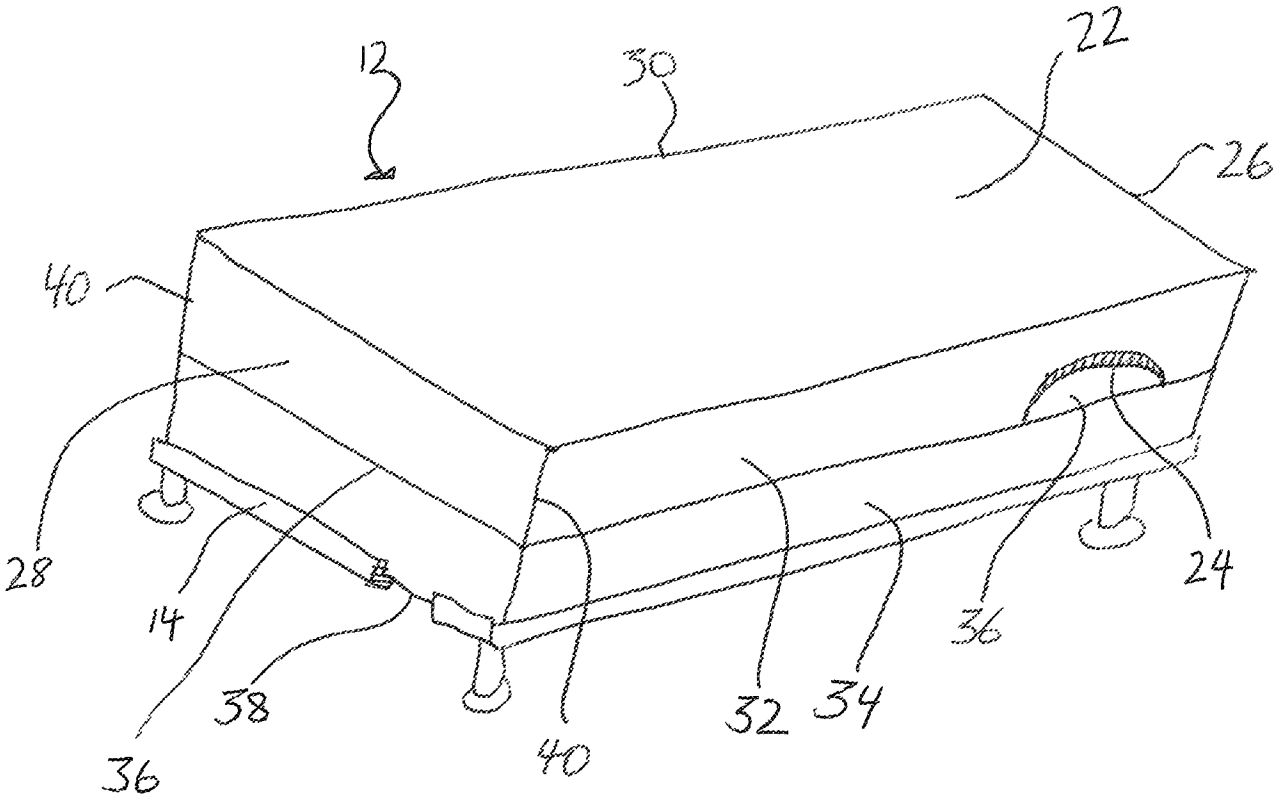
FIG. 1 is substantially a perspective cutaway top view of one version of a bed that could be used in combination with the present invention.
Figure 2:
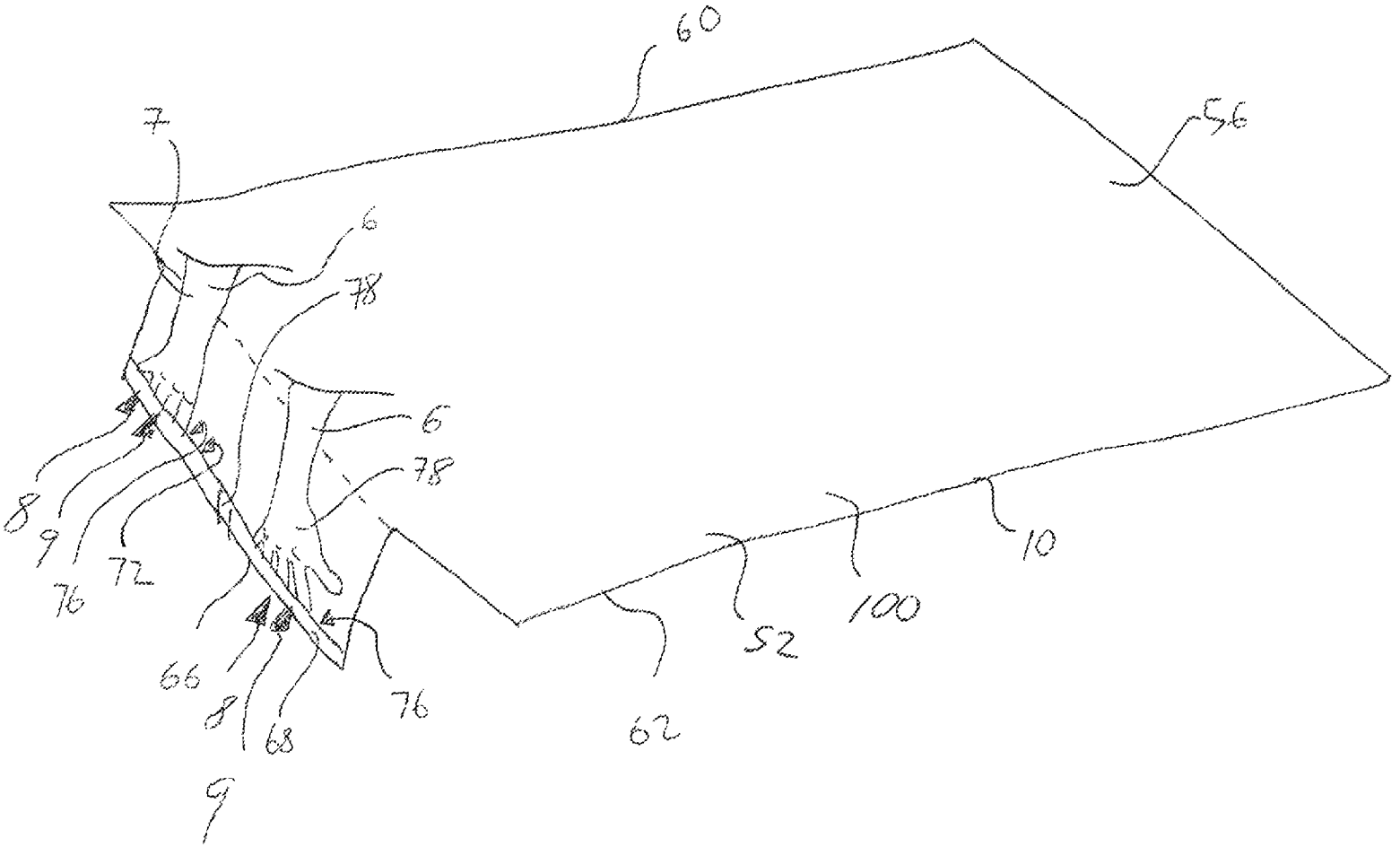
FIG. 2 is substantially a perspective cutaway top view of one embodiment of the present invention.
Figure 2A:
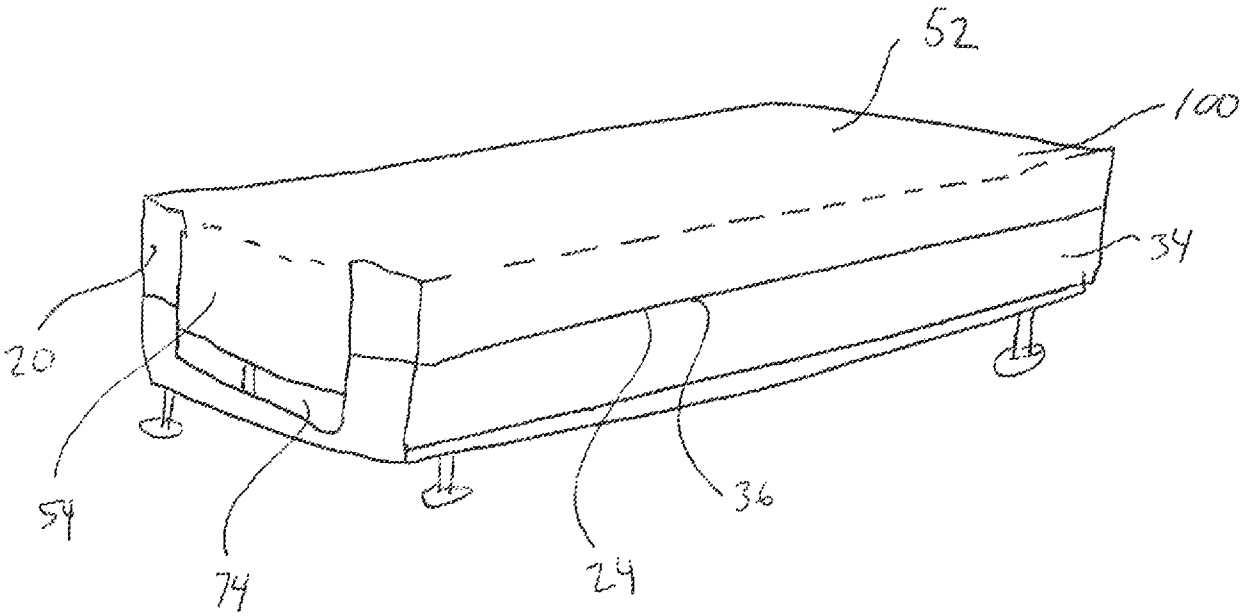
FIG. 2A is substantially a perspective cutaway top view of one embodiment of the present invention lying upon a mattress.

As substantially shown in FIG. 1, one possible version of a bed 12 that the invention 10 could be applied to could comprise a mattress 20. In one embodiment, the mattress 20 could be subsequently supported by a mattress support such as a bed frame 14. In one version of such an embodiment, the mattress could be substantially supported by a box spring 34 placed in between the mattress support and the mattress 20.

In one such embodiment, the mattress 20 could be a casing made from suitable fabric containing deformable or resilient material (not shown) for sleeping. The mattress 20 could have a top mattress portion 22 connected to a bottom mattress portion 24 by a head end 26, a foot end 28, a first mattress side 30 and a second mattress side 32. The head end 26 and foot end 28 could oppose each other in a parallel orientation, the head end 26 and foot end 28 further being connected to one another by the first mattress side 30 and the second mattress side 32. The portions of the mattress 20 denoted by where the foot end 28 connects to the first mattress side 30 and second mattress side 32 could be considered the foot end corners 40.

The box spring 34 could be a fabric covered frame housing a set of vertical springs (not shown.) The box spring 34 could be similarly shaped as the mattress 20 and could support the mattress 20 upon the box spring's top 36. The box spring's bottom 38 could be supported by a bed frame 14, which in one possible embodiment could be a set of connected support railings lifted off the floor by support legs.

As substantially shown in FIGS. 2, 3A, 3B, 3C and 4, the invention 10 could comprise a base cover 102 and a tab sheet 54 that generally connect to form a T-shape. The base cover 102 could be rectangular in shape and may be applied to the top mattress portion 22. The base cover 102 may be defined by defined by a top base edge 56, a bottom base edge 58, a first side base edge 60 and second side base edge 62 wherein the top base edge 56 and bottom base edge 58 may oppose one another in a parallel fashion and could be further connected to one another by the first side edge 60 and second side edge 62.

The tab sheet 54 could also be rectangular in shape but generally smaller in size to the base sheet 52 (the tab sheet 54 could have a width and length that is respectively less that of the width and length of the base sheet 52) so that tab sheet 54 generally does not contact the base sheet's first base edge 60 and second base edge 62. The tab sheet 54 could comprise a pocket tab portion 64 and a top tab portion 66, the top tab portion 66 generally connecting the tab sheet 54 (e.g., top tab portion) to the bottom base edge 58. The pocket tab portion 64 could form an open-end pocket 68 having a pocket aperture 70 substantially used to access the open-ended pocket's interior 72. The pocket aperture 70 further generally opening out upon top tab portion 66 and generally towards the bottom base edge 58. The open-ended pocket 68 in at least one embodiment being sufficiently constructed to generally accommodate at least a portion of a hand 7 of an operator 6. In another embodiment, the open-ended pocket 68 could accommodate both of the operator's hands 7 (either partially accommodate in one version or fully accommodate in another version) in the fully extended or open-handed position 8 with fingers 9 either spread apart from one another or with the fingers 9 closed together with one another.

Figure 3:
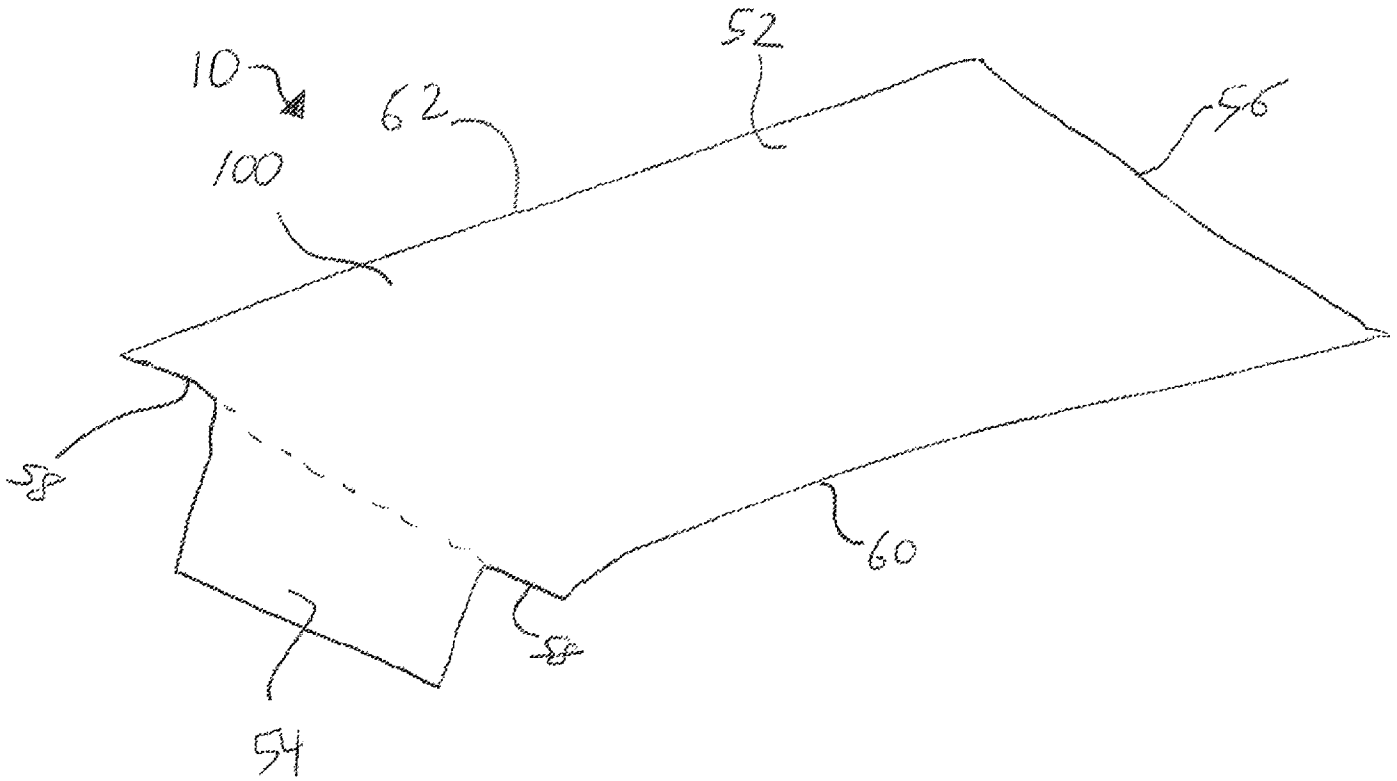
FIG. 3 is substantially a perspective bottom view of one embodiment of the present invention.
Figure 3A:
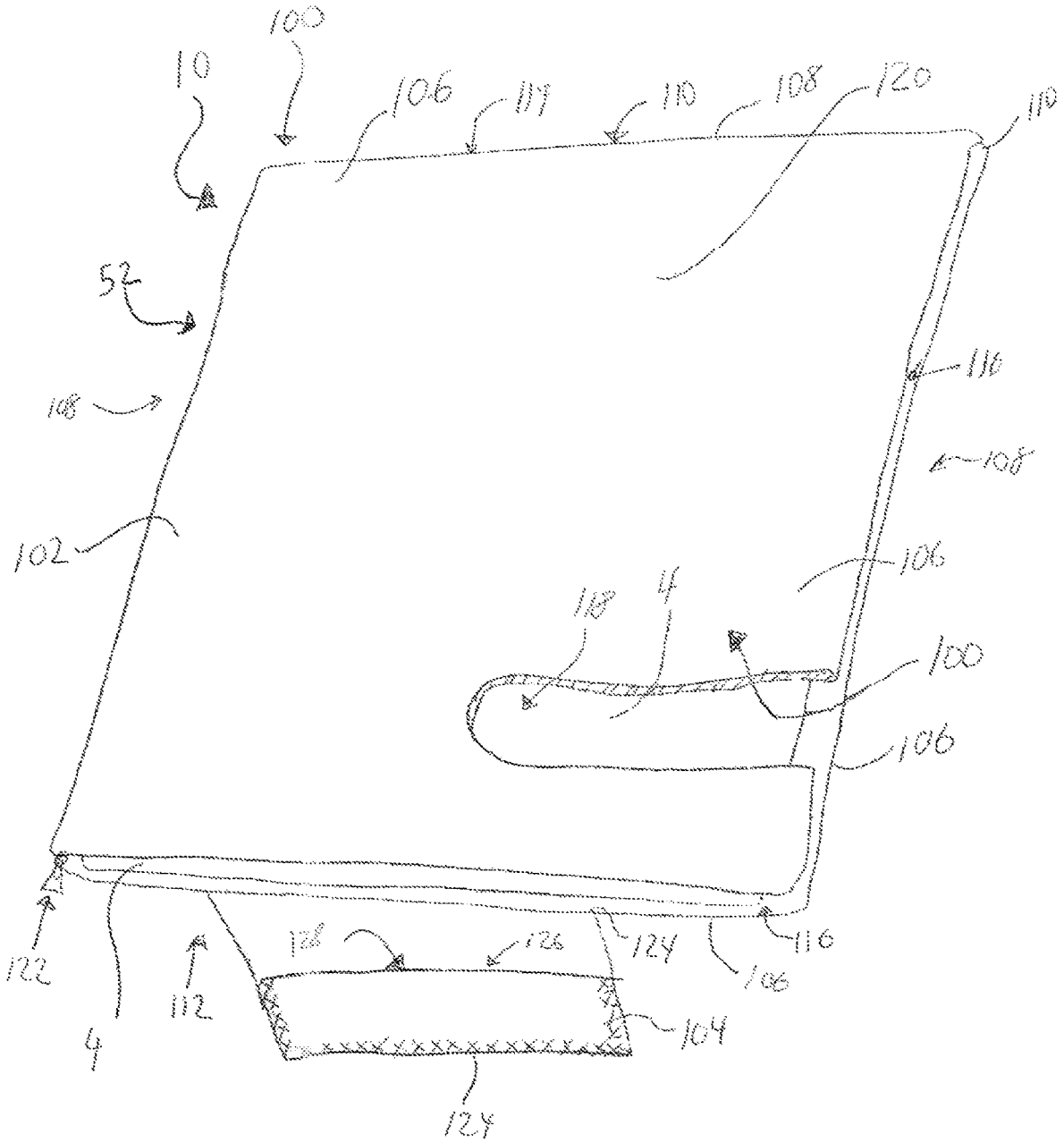
FIG. 3A is substantially a perspective cutaway top view of the present invention.

As substantially shown in FIG. 3A, the present invention 10 could be a duvet or quilt cover 100. The duvet 100 (e.g., a quilt 4 removably enclosed within duvet 100) could have a base sheet 52 being a base cover 102, the base cover 102 connects with a smaller width tab sheet 104. The base cover 102 could comprise two duvet sheets 106 at least partially connected together, each duvet sheet 106 being substantially rectangular with two sheet side edges 108 connecting a top (or head) sheet end edge 110 with a bottom (or foot) sheet end edge 112. A top (or head) sheet end edge 114 could connect together a pair of top (e.g., head) sheet end edges 110 and an adjacent pair of sheet side edges 108. The remaining pair of sheet side edges 108 and adjacent bottom (e.g., foot) sheet end edges 112 could define a continuous and sealable duvet aperture 116 for connecting the duvet interior 118 as defined by the connected base cover sheets to a duvet exterior 120. The duvet aperture 116 could be reversibly sealed by a variety of well-known sealing apparatuses such a zipper 122, spaced-apart snaps, hole and button combination, hook and loop combination, ties, and the like.

The tab sheet 104, being generally rectangular in shape, may be neither as wide nor long as the base cover 102. The tab sheet 104 could be connected by one tab sheet end edge 124 to one of the bottom sheet edges 112 to extend outward from the attached bottom sheet edge 112. The tab sheet 104 could be centralized relative to the said base cover bottom sheet edge 112 to generally present as a stem of an T of an overall shape of the formed duvet 100.

Figure 5:
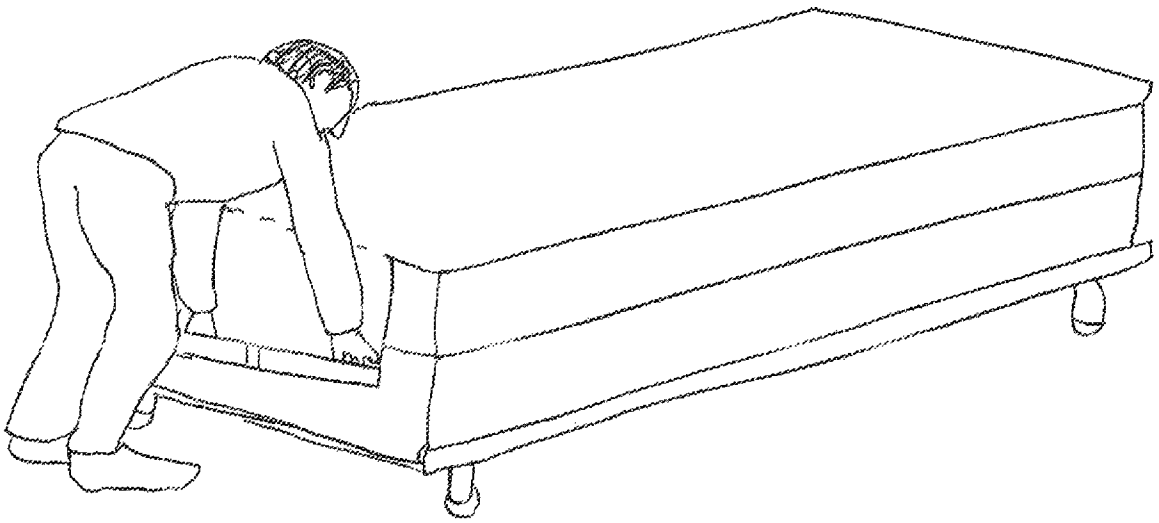
FIG. 5 is substantially another perspective view of one embodiment of the present invention being applied to the bed.

The tab sheet 104 could further define an open-ended pocket 126 proximate to the unattached other tab sheet end edge 124, the sealed end of the open-end pocket 126 being aligned with the other tab sheet end edge 124. The open-ended pocket 126 could further form a pocket aperture 128 that opens out onto the remaining portion of the tab sheet 104 and could further allow passage of at least a portion of an operator's hand 7 (as sheen in FIG. 5) into the open-ended pocket 126.

Figure 3B:
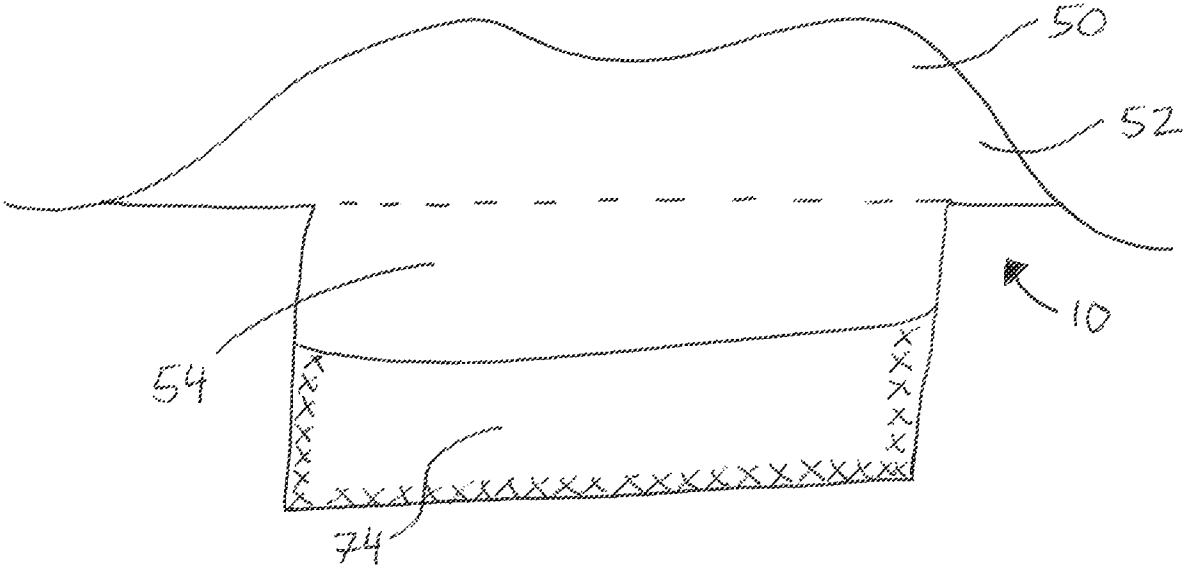
FIG. 3B is substantially a perspective view of one embodiment of the open-ended pocket of the present invention.
Figure 3C:
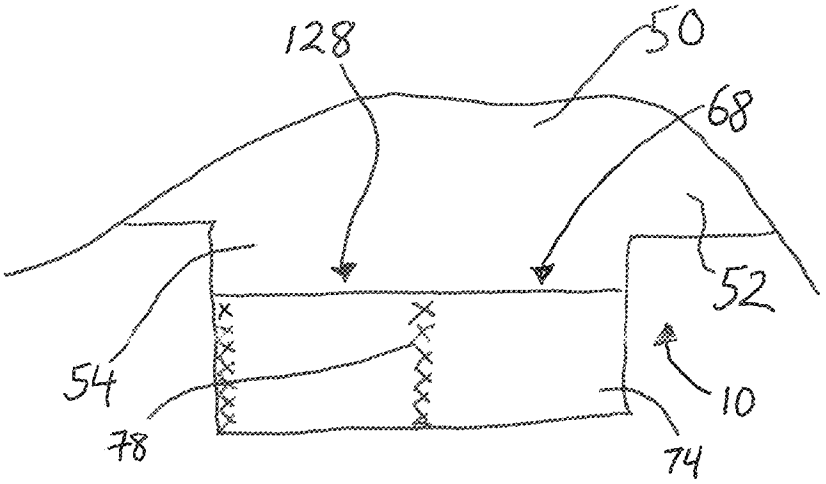
FIG. 3C is substantially a perspective view of another embodiment of the open-ended pocket of the present invention.
Figure 4:
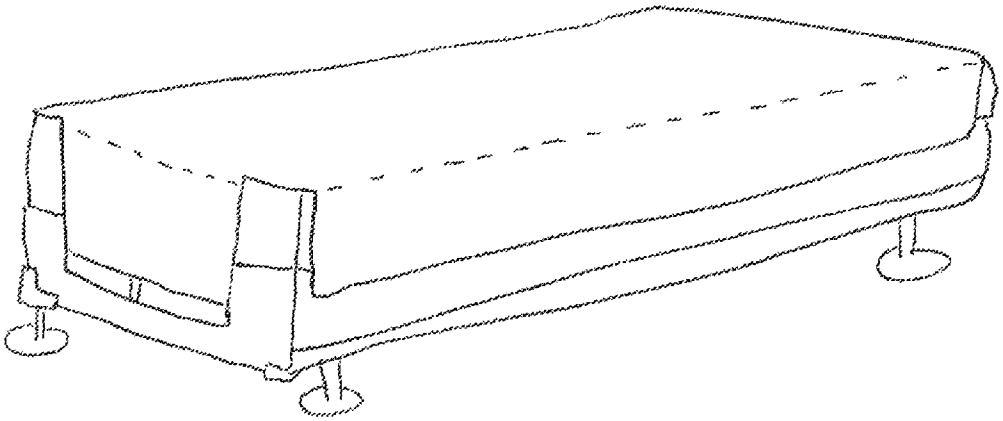
FIG. 4 is substantially a perspective view of one embodiment of the present invention being applied to the bed.

As substantially shown in FIGS. 3B and 3C, the open-ended pocket 68, 126 for various embodiments of the invention 10 could be formed by overlaying a pocket sheet 74 to the tab sheet 54 to form the pocket tab portion 64 so that the edges of the pocket sheet 74 that contacts and connects to the sides and bottom of the tab sheet 54 to generally form the pocket aperture 128 that substantially opens out upon the top tab portion 66.

Figure 6:
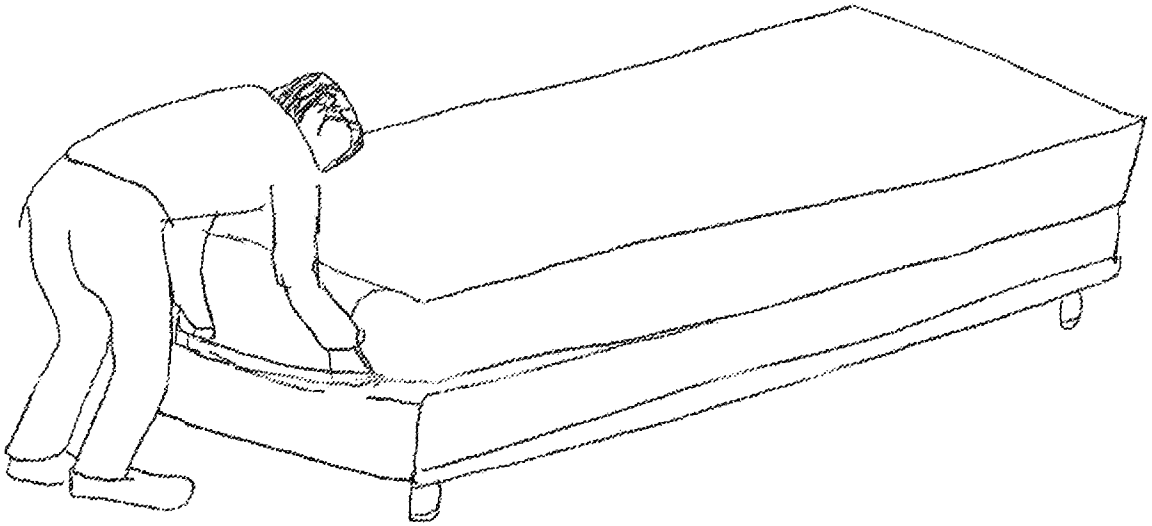
FIG. 6 is substantially a yet another perspective view of one embodiment of the present invention being applied to the bed.
Figure 7:
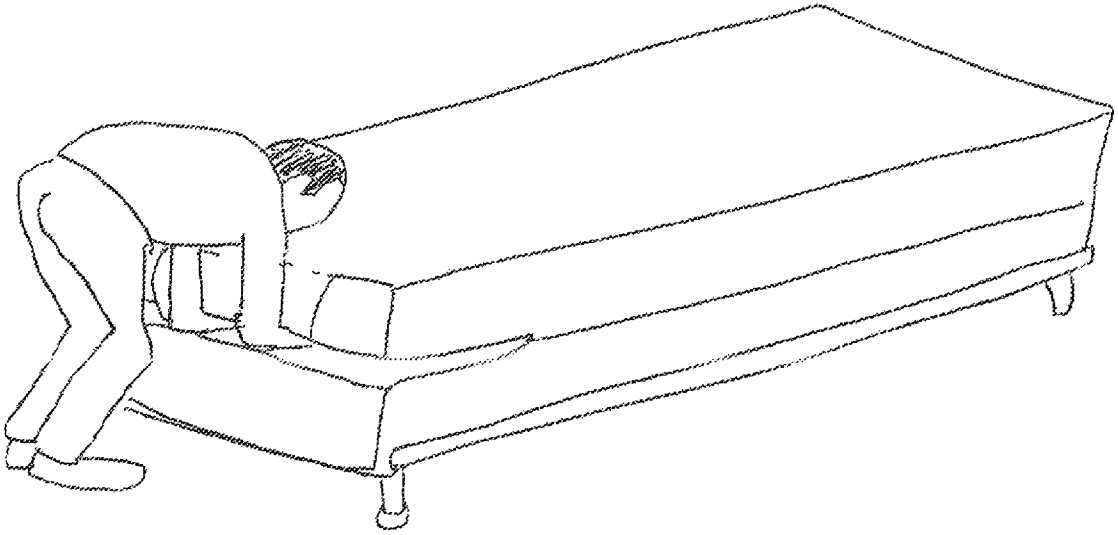
FIG. 7 is substantially a still yet another perspective view of one embodiment of the present invention being applied to the mattress.
Figure 8:
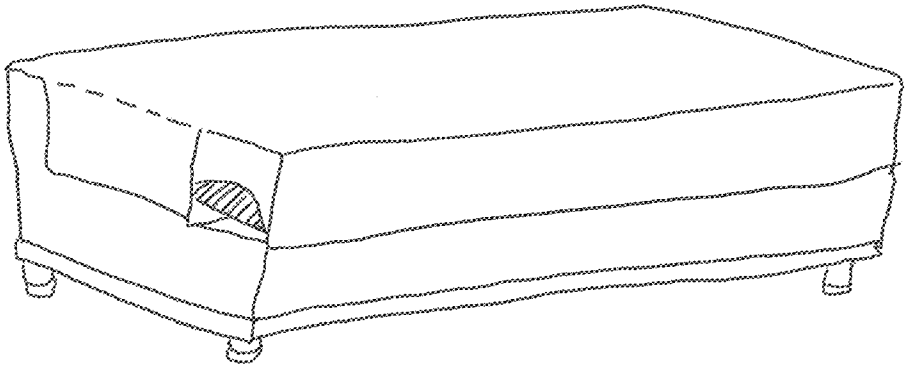
FIG. 8 is substantially a perspective cutaway view of one embodiment of the present invention being applied to the mattress.
Figure 9:
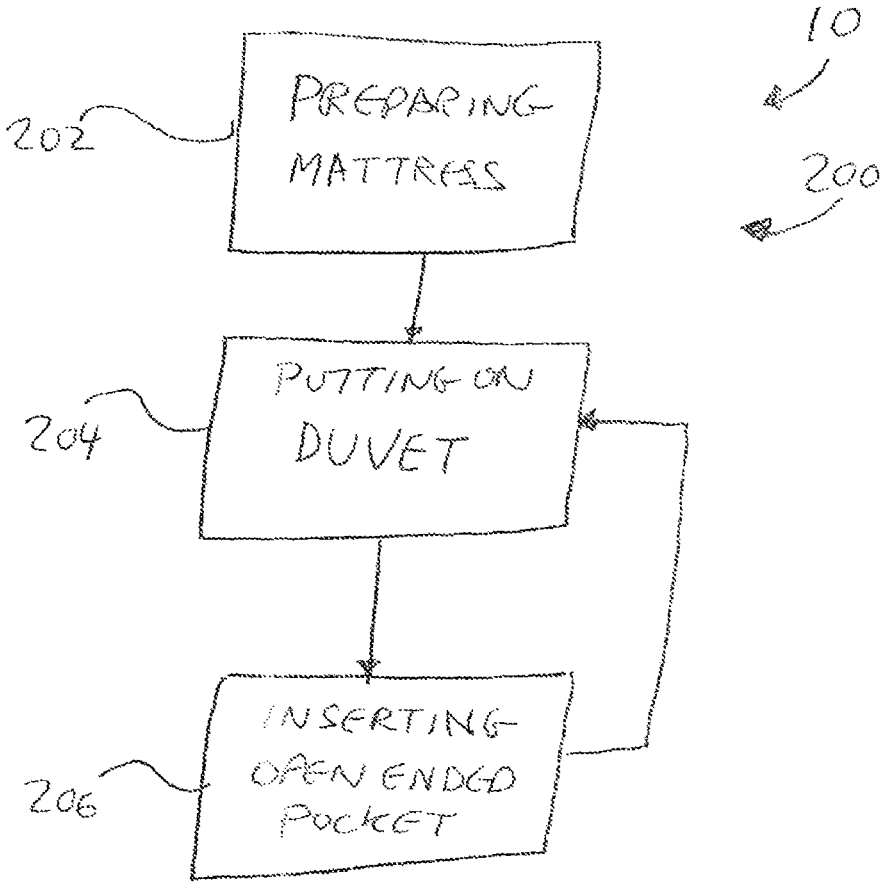
FIG. 9 is substantially a flowchart schematic showing one possible embodiment of a process or method for operating the present invention.

In various embodiments, the open-ended pocket 126 could be formed by folding back a part of the tab sheet 54 upon itself and subsequently generally sealing the three sides of the folded upon part to substantially denote the pocket aperture 70, 128 of open-ended pocket 68, 126. In yet another embodiment, the pocket tab portion 64 could be attached (e.g., sewed) down the middle with a midline seam 78 to bifurcate the open-ended pocket 68 and the aperture 128 forming two open-ended sections 130 with each section 130 being able to substantially receive at least a portion of a respective hand 7 of the operator 6 (as substantially shown in FIGS. 2, 5 and 6.)

In this manner, after the invention 10 has been laid over the mattress 20 (or over other bed covers previously applied to the mattress 20), the operator 6 could place at least a portion of one hand 7 into the open-ended pocket 126, 68 to guide at least the open-ended pocket 126, 68 and a hand 7 combination towards and underneath the mattress 20 (e.g., be inserted between a mattress 20 and a mattress support such as a box spring 14) without having to substantially grasp the remaining portion of the invention 10 to do so.

Method

As substantially shown in FIGS. 4-9, one possible method, process or procedure 200 for operating the invention 10 could start with step 202 preparing the mattress. In this step, the sheet size of the invention could be determined based on the standard sizes (e.g., king, queen, standard, double, single, etc.) of the selected mattress or the quilt. Once the size selection of the invention is determined, fitted sheets (box spring cover, mattress cover, and fitted mattress sheet could be suitably applied to the box spring and mattress.) Once the mattress is prepped, the method 200 could proceed to step 204 putting the duvet onto the mattress.

In step 204 putting the duvet onto the mattress, the operator could place the duvet upon the mattress so that the top portion is located upon the top mattress portion as the tab sheet is generally left hanging down off the mattress' foot end. The open-ended pocket could be facing away from the foot end to expose the aperture to allow the operator access to the open-ended pocket. Then depending on the particular embodiment of the invention, the operator could put at least a portion of the operator's hand through the aperture and into the open-ended pocket. The hand could be fully extended (e.g., open-handed) with the palm generally facing the mattress. In the bifurcated version of the open-ended pocket, the operator could place both hands into the open-ended pocket with each hand being substantially being placed in a respective section. In that version, each hand could be located within a respective section to be touching the tab sheet edge (e.g., the open-ended pocket edge that is opposite the aperture) of the section (e.g., hands could be spread apart to be located by the sides of the pocket portion.) The fingers of the respective hand could be spread apart from one another, or the fingers of the respective hand could be placed alongside one another as the hand's fingertips generally engage bottom seam of the open-ended pocket. As this step is substantially completed, the method 200 could proceed to the step 206, inserting the open-ended pocket underneath the bottom mattress portion.

In the step 206, inserting the open-ended pocket underneath the bottom mattress portion, the operator could direct its hand(s) and hence the engaged open-ended pocket towards the bottom mattress portion. Once the pocket portion is so inserted, the operator could move its hand(s) within the pocket portion so that the pocket portion substantially lays flat underneath the mattress for a maximum adhesion to the mattress bottom (e.g., or for being held between the mattress and the mattress support.) The pocket portion could be so placed under the bottom mattress portion (e.g., inserted in between the box spring and the mattress) so that the pocket tab portion is generally placed against a middle of the foot edge and/or underneath the mattress to centralize the duvet upon the mattress. Once the open-ended pocket is correctly placed, the operator can remove her hand(s) from the open-ended pocket, leaving the open-ended pocket generally sandwiched against the mattress to substantially anchor the duvet to the mattress.

As anchored, the duvet at the foot corners could be loose and non-constrictive at that portion of the bed to substantially allow the operator the freedom to swing her feet out through the foot corners to get out of bed. The bed, now lacking the hospital corner tautness, relieves pressure of the duvet upon the feet of the operator while still holding the duvet in place upon the bed during usage. The operator with the duvet so anchored and centered upon the bed, can make the bed faster, with less effort/greater ease, in that operator only needs to bring one side of the duvet into place and then move over to the other side to bring that portion of the duvet into place.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As generally shown and described the invention could be a duvet that has a generally rectangular base sheet with a tab sheet extending form the bottom base edge to generally form a T-shape. The tab sheet at a non-attached end that is the furthest away from the base sheet could have an open-ended pocket. An operator could place at least a portion of the operator's hand to insert the pocket underneath the mattress to generally secure the duvet to the mattress. The tape having smaller size than the base sheet would not connect to the corners of the base sheet. This invention allows the operator to inset the tab sheet without having to grasp the duvet edge (the operator could place at least a portion of one hand into the open-ended pocket to guide at least the open-ended pocket towards and underneath the mattress [e.g., be inserted between a mattress and mattress support]. The invention secures the duvet to the mattress in a manner that could allow the for easy swinging of the operator's feet out from the bed, relieving duvet tautness or tension upon the operator's feet, and easing the making of the bed (e.g., centering of the duvet by the tab sheet.)

What is claimed is:

1. A duvet and mattress combination comprising:

A) the duvet comprising a comprising a base cover and tab sheet that forms a T-shape, the base cover defines a hollow interior accessible through a resealable aperture that is continuously located along a full length of a base cover bottom edge and a full length of a base cover side edge that is adjacent to one base cover bottom edge, the hollow interior further configured to removably receive a quilt and a continuous seam forms a base cover top edge and an adjacent another base cover side edge, the tab sheet comprises a pocket portion and a base portion, the base portion attached to the base cover proximate to the base cover bottom edge while the pocket portion forms an open-end pocket having a pocket aperture that opens out upon the base portion, the open-ended pocket being sufficiently constructed to accommodate at least a portion of an operator's first hand; and C) a mattress having a top and a bottom connected together by a head end, a first mattress side, a second mattress side and a foot end forming a mattress width that is greater than a width of the tab sheet;

wherein the base cover lies over the top of the mattress, the open-ended pocket being placed underneath the mattress against the bottom to allow the combination to form a foot corner that allows easy passage of an operator's foot through the foot corner, a portion of the tab sheet is folded against a foot end of the mattress to align the pocket aperture with an edge of the foot end.

2. The combination of claim 1 wherein the open-ended pocket is further constructed to additionally accommodate at least a portion of a second hand of the operator.

3. The combination of claim 1 wherein the tab sheet and the base cover together form a T-shape.

4. The combination of claim 1 wherein the tab sheet does not attach to an entire length of the bottom base cover edge.

5. The combination of claim 1 wherein the pocket aperture opens out upon the top tab portion.

6. The combination of claim 1 wherein the duvet is unitary.

7. The combination of claim 1 wherein the hollow interior removably receives a quilt.

8. A duvet and mattress combination comprising:

A) the duvet comprising a base cover and a tab sheet that connect together to form a T-shape, the base cover further defines a hollow interior accessible through a resealable aperture, the hollow interior further configured to removably receive a quilt through the resealable aperture, the resealable aperture is continuously located along a full length of a base cover bottom edge and the full length of a base cover side edge that is continuously adjacent to the base cover bottom edge, and a continuous seam forms a base cover top edge and an adjacent another base cover side edge;

B) one end of the tab sheet further forms an open-ended pocket having a pocket aperture that can allow passage of at least a portion of a first hand of the operator into the open-ended pocket; wherein the pocket aperture further opens out onto the remaining tab sheet in a manner that allows the operator to move a combination of the at least portion of the first hand within an interior of the open-ended pocket to a position underneath a mattress to which the duvet is being applied, the open-ended pocket being sufficiently constructed to accommodate at least a portion of a first hand of an operator passing through the pocket aperture; and C) a mattress having a top and a bottom connected together by a head end, a foot end, a first mattress side and a second mattress side forming a mattress width that is greater than a width of the tab sheet;

wherein the base cover lies over the top of the mattress, the open-ended pocket lies underneath the mattress against the bottom to allow the duvet and mattress combination to form a foot corner that allows easy passage of the operator's foot through the foot corner, a portion of the tab sheet is folded against a foot end of the mattress to align the aperture with an edge of the foot end.

9. The combination of claim 8 wherein the base sheet and tab sheet are both rectangular.

10. The combination of claim 8 wherein the tab sheet does not meet a first edge base side or a second edge base side of the base cover.

11. The combination of claim 8 wherein the hollow interior removably receives a quilt.

12. A method of combining a duvet with a mattress comprising the following steps:

A) providing a duvet, the duvet comprising a base cover and a tab sheet that connect together to form a T-shape, the base cover further defines a hollow interior accessible through a resealable aperture, the hollow interior further removably holds a quilt, the resealable aperture is continuously located along a full length of a base cover bottom edge and a full length of a base cover side edge that is adjacent to the base cover bottom edge, and a continuous seam forms a base cover top edge and an adjacent another base cover side edge, one end of the tab sheet further forms an open-ended pocket having a pocket aperture that can allow passage of at least a portion of a first hand of the operator into the open-ended pocket; wherein the pocket aperture further opens out onto the remaining tab sheet in a manner that allows the operator to move of the at least portion of the first hand within an interior of the open-ended pocket to a position underneath a mattress to which the duvet is being applied, the open-ended pocket being sufficiently constructed to accommodate at least a portion of a first hand of an operator passing through the pocket aperture;

B) providing a mattress having a top mattress portion connected by mattress sides to a bottom mattress portion;

C) inserting the at least a portion of the first hand of the operator into the open-ended pocket; and D) directing the open-ended pocket towards the bottom mattress portion to locate at least a portion of the open-ended pocket under the bottom mattress portion.

13. The method of claim 12 wherein the directing the combination further comprises a step of inserting the combination between the mattress and a box spring.

14. The method of claim 12 wherein the pocket aperture opens out upon the tab sheet.

15. The method of claim 12 wherein the inserting at least a portion of the operator's one hand into the open-ended pocket further comprises a step of inserting at least a portion of the operator's second hand into the open-ended pocket.

16. The method of claim 12 wherein inserting the at least a portion of operator's first hand into the open-ended pocket further comprises the step of placing the at least a portion of the operator's first hand into an open-handed position.

17. The method of claim 16 wherein the placing the operator's hand into an open hand position further comprises a step of spreading fingers apart from one another.

18. The method of claim 12 wherein the open-ended pocket being further bifurcated into sections to allow the step of inserting at least a portion the operator into the open-ended pocket to further comprise a step of accommodating the at least a portion of the operator's first hand into one section of the open-ended pocket and accommodating at least a portion of the operator's second hand into another section of the open-ended pocket.

19. The method of claim 18 further comprises a step of subsequently removing the at least portion of the operator's first hand from the one section of the open-ended pocket while leaving the open-ended pocket underneath the mattress.

20. The method of claim 19 step of subsequently removing the at least portion of the operator's first hand further comprises a step of subsequently removing the at least portion of the operator's second hand from the another section of the open-ended pocket while leaving the open-ended pocket underneath the mattress.

* * * * *